United States Patent [19]

Albrecht

[11] Patent Number: 4,845,867

[45] Date of Patent: Jul. 11, 1989

[54] TRIPLE-PURPOSE ATTACHMENT

[75] Inventor: Allan J. Albrecht, Rothschild, Wis.

[73] Assignee: Wausau Machine and Technology, Inc., Wausau, Wis.

[21] Appl. No.: 167,706

[22] Filed: Mar. 14, 1988

[51] Int. Cl.[4] ..... E02F 3/76

[52] U.S. Cl. ..... 37/117.5; 37/103; 37/DIG. 3; 414/912; 414/722

[58] Field of Search ..... 37/2 R, 2 P, 103, 117.5, 37/DIG. 3; 414/912, 704, 722, 724, 726, 729, 739–740

[56] References Cited

U.S. PATENT DOCUMENTS

| | | | |
|---|---|---|---|
| 3,148,787 | 9/1964 | Clark et al. | 37/117.5 |
| 3,250,028 | 5/1966 | Hunger et al. | 37/117.5 |
| 3,273,729 | 9/1966 | Holopainen . | |
| 3,613,923 | 10/1971 | Albright | 37/117.5 |
| 3,732,980 | 5/1973 | Evers et al. | 37/117.5 |
| 3,854,608 | 12/1974 | Arnold | 37/117.5 |
| 4,327,509 | 5/1982 | Bean | 37/117.5 |
| 4,372,063 | 2/1983 | Work | 37/DIG. 3 |
| 4,375,345 | 3/1983 | Hanson | 414/722 |
| 4,403,906 | 9/1983 | Holopainen | 37/DIG. 3 |
| 4,635,386 | 1/1987 | Kobayasi | 37/DIG. 3 |

FOREIGN PATENT DOCUMENTS

| | | | |
|---|---|---|---|
| 154439 | 9/1985 | European Pat. Off. | 37/117.5 |
| 624993 | 9/1978 | U.S.S.R. | 37/117.5 |
| 771254 | 10/1980 | U.S.S.R. | 37/117.5 |
| 827695 | 5/1981 | U.S.S.R. | 37/103 |
| 972011 | 11/1982 | U.S.S.R. | 37/117.5 |

*Primary Examiner*—Eugene H. Eickholt
*Attorney, Agent, or Firm*—Allen H. Erickson

[57] ABSTRACT

A triple-purpose attachment for articulated back-hoes and the like comprises an earth-working bucket having a clamping/scarifying arm mounted to pivot in an arc about the same axis as the bucket, or about another axis passing through the bucket normal to the longitudinal axis of the dipper stick. The arc is fixed relative to the bucket. The lower end of the arm includes forward and rear teeth, and the arm is pivotably moved by hydraulic motive means to be useful by itself or in combination with the bucket in excavation, ripping, lifting, moving and turning objects.

14 Claims, 6 Drawing Sheets

TRIPLE-PURPOSE ATTACHMENT

BACKGROUND OF THE INVENTION

1. Field of the Invention

This invention relates to excavation machines such as backhoes, front-end loaders, power shovels, and the like. More particularly, this invention relates to multi-function attachments for excavation machines.

2. Information Disclosure Statement

Earth moving equipment such as backhole and power shovels are commonly used for excavation of soils or other materials which can be readily penetrated by the leading edge of a bucket. The backhoe typically comprises a pivotable bucket on the end of an articulated arm assembly having its members moved by hydraulic cylinders. The leading edge of the bucket or shovel is sometimes equipped with sharp teeth to assist in penetration.

However, many commonly-encountered obstacles interfere with efficient use of such excavating machines. Large stones, tree roots, logs, pieces of concrete, pipes and similar materials must be extricated and removed. Crustaceous materials such as pavement often must be ripped and removed to expose the earth beneath and permit its excavation.

Bean U.S. Pat. No. 4,327,509 describes a ripper tooth attachment for a backhoe, the device being pivoted about the bucket end of the dipper stick, and actuated by a hydraulic cylinder or ram mounted on the center pin connecting the boom and the dipper stick. The device is not useful for clamping about objects for lifting them.

Holopainen U.S. Pat. No. 3,273,729 shows a clamping device for attachment to a backhoe, for grasping and moving objects. The grasped object cannot be effectively turned without precise simultaneous control of both the bucket cylinder and the clamping arm cylinder. Simple control of the bucket to pivot it upward and outward will result in separation of the gripping members and loss of the clamped object. The attachment is not useful for ripping or scarifying.

SUMMARY OF THE INVENTION

This invention is a unitary triple purpose attachment for an articulated excavation machine such as a crane or backhoe. The attachment includes an earth-working bucket having two spaced side walls joined by a concave shaped pan. The bucket has mounting means on its upper part for pivotable attachment to a dipper stick of the excavation machine. The lower edge of the pan at the bucket mouth comprises a leading excavation edge for penetrating the material to be excavated. The bucket pivots about a generally horizontal axis normal to the longitudinal axis of the dipper stick. A clamping-scarifying arm is pivotably mounted at its proximal, i.e. upper end to the bucket, to pivot in an arc about an axis passing through the bucket or bucket mounting means, the axis being normal to the longitudinal axis of the dipper stick. The distal or lower end of the arm includes a forward tooth for ripping or scarifying hard ground and crustaceous materials, dislodging buried objects and the like; and a rear tooth for ripping and scarifying, as well as clamping objects against the bucket for lifting and moving them, and for other operations. The arm is pivotable between an upper position away from the bucket, and a lower position adjacent the bucket, where the toothed lower end of the arm is adjacent the leading edge of the pan. Its motion defines a fixed arc relative to the bucket. A hydraulic motive means is pivotably mounted to the arm to move the arm in the fixed arc and to maintain the arm in any desired angular position in the arc relative to the bucket, irrespective of the bucket's position. The hydraulic motive means may be a hydraulic cylinder ram mounted on the bucket pan or on the bucket mounting means. Control of the hydraulic fluid to the cylinder results in positioning of a piston therein which in turn positions are at the desired angle. In this invention, the arm and bucket may be maintained at a constant angle relative to each other, so that objects are easily lifted and moved. Inadvertent dropping of the object is avoided, even during manipulation of the triple-purpose attachment relative to the dipper stick, greatly enhancing the efficiency and safety of operations which can be hazardous.

The triple-purpose attachment is attached and detached from the dipper stick of an excavating machine as a singular or unitary machine. Neither the arm nor the ram is separately attached to the dipper stick. The triple-purpose attachment is connected in the same manner as simple buckets, with only additional hydraulic hose connections to the ram.

BRIEF DESCRIPTION OF THE DRAWINGS

Other features, aspects and advantages of the invention will hereinafter become apparent from the following detailed description and the appended drawings, in which:

FIG. 10 is a side elevation of this invention, illustrating its use in lifting large stones and the like;

DESCRIPTION OF THE PREFERRED EMBODIMENTS

Figure 1:
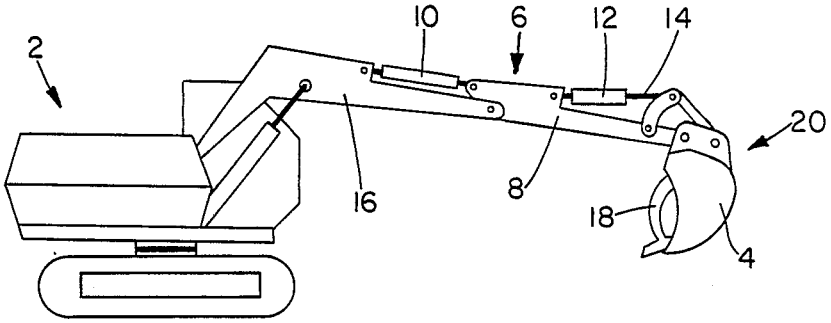
FIG. 1 is an overall side view of a typical backhoe machine equipped with the triple-purpose attachment of this invention, illustrating the bucket and clamping/-scarifying arm.

Turning now to FIG. 1, the present invention is a triple-purpose attachment 20 for use on a lift-arm assembly 6 of apparatus such as backhoe machine 2. Triple-purpose attachment 20 includes bucket 4 mounted on dipper stick 8 and adapted to be rotated by hydraulic cylinder 12 acting through piston rod 14. Dipper stick 8 is pivotably mounted on boom 16 and may be motivated by second hydraulic cylinder 10. Triple-purpose attachment 20 also includes arm 18 which has a construction and particular advantageous uses which are described in this disclosure.

Several different embodiments of this invention use alternate hingepin locations for pivotably mounting the clamping/scarifying arm 18 and an arm positioning hydraulic cylinder ram. Certain features are common to all embodiments and result in the unique utility of this apparatus. This disclosure describes the preferred embodiment in detail.

Figure 2:
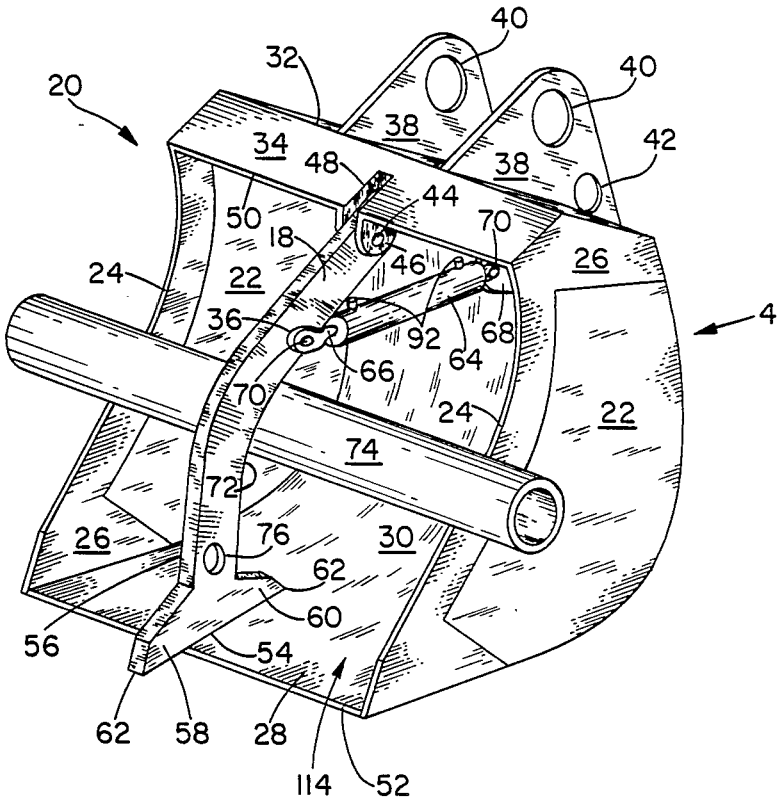
FIG. 2 is an orthographic view of one embodiment of the triple-purpose attachment of this invention.

One embodiment of the invention is shown in FIG. 2. Triple-purpose attachment 20 includes an earth-working bucket 4 with a pair of side walls 22, each having a forward edge 24. The space between the edges 24 comnprises a bucket mouth 114. A portion fo each side wall 22 may include reinforcement 26 of added thickness to strengthen the bucket against wear and bending forces during use. A pan 28, which likewise may be reinforced, typically comprises an arcuate portion 30 and one or more upper pan portions 32 and 34, and is joined to a portion of the edge of both side walls 22 to form bucket 4 of attachment 20. Alternatively, the pan 28 may comprise a single arcuate section, or may be made up of a plurality of planar sections, or may have another configuration. The drawings show the exemplary pan 28 as including generally flat upper pan portions 32 and 34. The leading edge 52 of pan 28 may be equipped with sharp teeth to facilitate penetration of hard and/or rocky soils. The particular shape of the bucket 4 is important to this invention only to the extent that it affects the cooperation of clamping/scarifying arm 18 with the bucket 4 to accomplish the hereindescribed ends of this invention. Backhoe bucket shapes commonly used in excavation may be adaptably utilized in the apparatus of this invention.

As shown in FIG. 2, a pair of bucket mounting members 38 is attached to the upper portion of bucket 4, in this case to one or both of the upper portions 32 and 34 of pan 28. Each of the mounting members 38 includes a front aperture 40 and a rear aperture 42, for pivotably attaching the dipper stick 8 and a bucket-actuating piston rod 14 to the bucket 4. Typically, the dipper stick is joined to the bucket 4 by a pin or pins through the front apertures 40, and the piston rod 14, connected to the bucket 4 by a pin or pins through apertures 42. Thus, attachment 20 may be pivoted by the articulating dipper stick 8 about a generally horizontal axis passing through apertures 40. This axis is normal to the longitudinal axis of the dipper stick apparatus.

Clamping/scarifying arm 18 is pivotably attached to upper pan portion 34 by, for example, pin 44 passing through a pair of arm mounts 46. Upper pan portion 34 is shown with a recess 48 extending inwardly from edge 50 between arm mounts 46. This permits arm 18 to be pivoted upward to a greater distance from leading edge 52 of pan 28 than would otherwise be possible.

Clamping/scarifying arm 18 has a generally rectangular cross-section and in its lower position extends generally to a position adjacent to the leading excavating edge 52 of the pan 28. Preferably, when fully retracted, that is, in the lowermost position, arm 18 partially extends into the bucket and a portion of its sole 54 is adjacent to, or in a limited case, in contact with the pan 28. The distal or lower end 56 of arm 18 includes a front tooth 58 and rear tooth 60. Preferably, the teeth 58 and 60 have sharp projections 62 useful for clamping, lifting and holding objects, ripping ground, grubbing roots from the ground, and so forth.

Arm 18 is pivotably connected to a hydraulic cylinder 64 through boss 36 on piston rod 66. The arm 18 and piston rod 66 are shown connected by a pin 70, but any means for pivotable connection may be used. The opposite end of cylinder 64 is connected by another pin 70 or similar device to cylinder mount 68 which is itself fixedly mounted on the pan 28. Hydraulic hoses from hydraulic control means, not shown, are connected to hose fittings 92 on cylinder 64 to provide pressurized hydraulic fluid to each end of the piston 64. The rod 66 may thus be moved in either direction and may be positioned in any desired position in its arc of movement. The design of such hydraulic rams and their control systems is well known.

As described herein, arm 18 is designed to enable its pivoting through a maximum angle which is dependent upon (a) the location of pin 44 in arm mounts 46, (b) the mounting position and reach of hydraulic cylinder 64 and piston rod 66, (c) the shape of multi-purpose arm 18, and (d) an optional recess 48 in the upper pan portion 34, through which arm 18 may pass.

Arm 18 may be generally straight between its two ends, but preferably has its inner or clamping side 72 concave, that is, curved away from the bucket in its central portion. This enables large diameter elongate objects such as pipe 74 to be clamped between the arm and the forward edges 24 of the side walls 22. While the side walls 22 are themselves shown with concave forward edges 24, the side walls may alternatively have straight forward edges, in which case the clamping side 72 of the arm must be concave to achieve the desired clamping ability.

Clamping/scarifying arm 18 is mounted to pivot in a vertical plane intermediate the planes of the two bucket mounting members 38. Preferably, this plane bisects the concave bucket pan 28 from top to bottom. Most preferably, the movement of the arm is in a plane equidistant between the two mounting members 38. Forces exerted on the arm 18 will then be uniformly transmitted to the dipperstick 8.

Arm 18 is shown as including arm aperture 76 through which chains or cables may be passed. Large boulders and the like may thus be girdled with the chain or cable and supported by the arm and bucket while being lifted and moved.

This invention is designed to be useful for earthworking while the multi-purpose arm 18 is fully attached and operable. However, removal of pins 70 permits the arm to be easily removed from bucket 4 without removing the triple-purpose attachment 20 from the dipper sitck 8.

Teeth 58 and 60 are useful for ripping earth and crustaceous layers such as pavement. Such ripping and scarifying may be performed in both the forward and reverse motion of the arm. When arm 18 is in an intermediate or lowered position, tooth 58 will break up the earth or crustaceous formation ahead of the bucket 4 as the attachment 20 is moved into the material to be excavated. Breakup of the earth and scooping by the bucket may be accomplished in the same motion. Subsequent dumping of the earth from the bucket is not hindered because arm 18 has a narrow cross-section, blocking only a small portion of the bucket mouth 114. Furthermore, arm 18 is easily rotated to an upper, open position without affecting the bucket position, by actuating the arm hydraulic cylinder 64. Objects may also be lifted by clamping them between the sharp projection 62 on tooth 60 and the leading edge 52 of the pan 28. Objects such as stumps, roots and boulders may be gripped and lifted in this manner.

An important feature of this invention is the pivotal attachment of both the arm 18 and the actuating hydraulic cylinder 64 to the bucket 4 or its mounting members 38. Thus, when lifting some object, the arm will be retained at the same position relative to the bucket, except when cylinder 64 is actuated. When an object is clamped by arm 18 against any part of the bucket, the object may be easily lifted or transported without experiencing a loss of clamping force, simply by operating the bucket pivot control to actuate hydraulic cylinder 12, shown in FIG. 1. The clamping force is positively controlled without the necessity of simultaneously manipulating the bucket pivot control through cylinder 12 and the arm pivot control through hydraulic cylinder 64. Simple pivoting of the attachment 20 and its load is accomplished without dropping the load, by operating only one control.

This invention is designed to be a unitary attachment, that is, it may be simply attached and detached from an excavation machine as a unit. There are no additional parts which may become lost during the attachment or detachment operations, during transportation, or during storage.

Figure 2A:
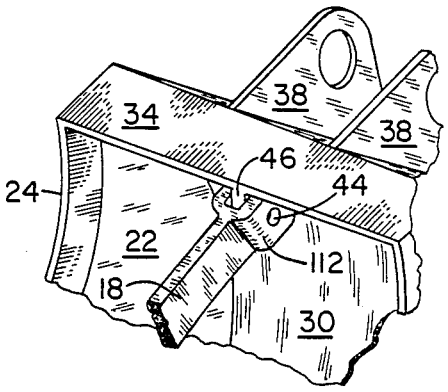
FIG. 2A is an orthographic view of the upper portion of the clamping/scarifying arm of a variation of the invention.

In FIG. 2A, an alternate arm pivotable attachment means is shown. The upper end of arm 18 terminates in a forked tang 112 with apertures through which a pin 44 is passed. Pin 44 also passes through arm mount 46, and arm 18 pivots about pin 44. Arm mount 46 may be attached to the inside or outside surface of upper pan portion 34.

Figure 3:
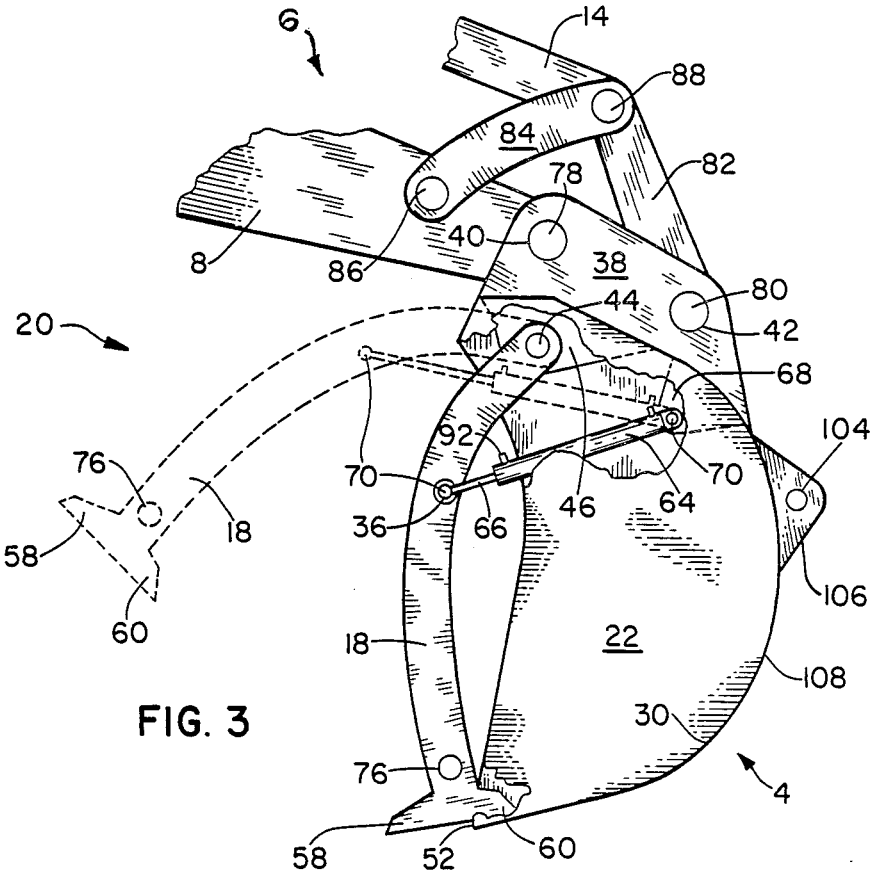
FIG. 3 is a side elevation of the embodiment of FIG. 2.

FIG. 3 is a side elevation view of the embodiment of FIG. 2, showing the attachment of the bucket 4 to the lift-arm assembly 6 of a backhoe machine. Dipper stick 8 is pivotably attached to bucket mounting members 38 by hinge pin 78 through front apertures 40. Arm link 82 is pivotably attached to members 38 by hinge pin 80 through rear apertures 42. Hinge pin 88 connects pistion rod 14, arm link 82, and arm link 84. The latter connects the piston rod 14 with dipper stick 8, and is connected to dipper stick 8 by hinge pin 86. Extension and retraction of piston rod 14 rotates bucket 4 in an angle about hinge pin 78.

In FIG. 3, clamping/scarifying arm 18 is shown in both the closed or retracted or clamping position, and in an open position where the front and rear teeth 58 and 60 are furthermore from leading edge 52 of the bucker. Hydraulic cylinder 64 is attached to cylinder mount 68, which is mounted on the inside rear wall of the bucket 4. The piston rod 66 is attached to arm 18, and cylinder 64 is attached to mount 68, pin 70 or other pivotable mounting means, and the actuation of rod 66 within cylinder 64 pivots the arm about pin 44.

The bucket 4 in FIG. 3 is shown with an optional chain/cable attachment 106 mounted on the exterior surface 108 of the bucket pan arcuate section 30. Chains, cables or other apparatus may be attached through aperture 104 in attachment 106 for lifting, pulling and so forth. For example, a boulder may be lifted and moved by stringing chains or cables around the boulder and attaching the two opposite ends to aperture 76 and chain/cable attachment 106.

Figure 4:
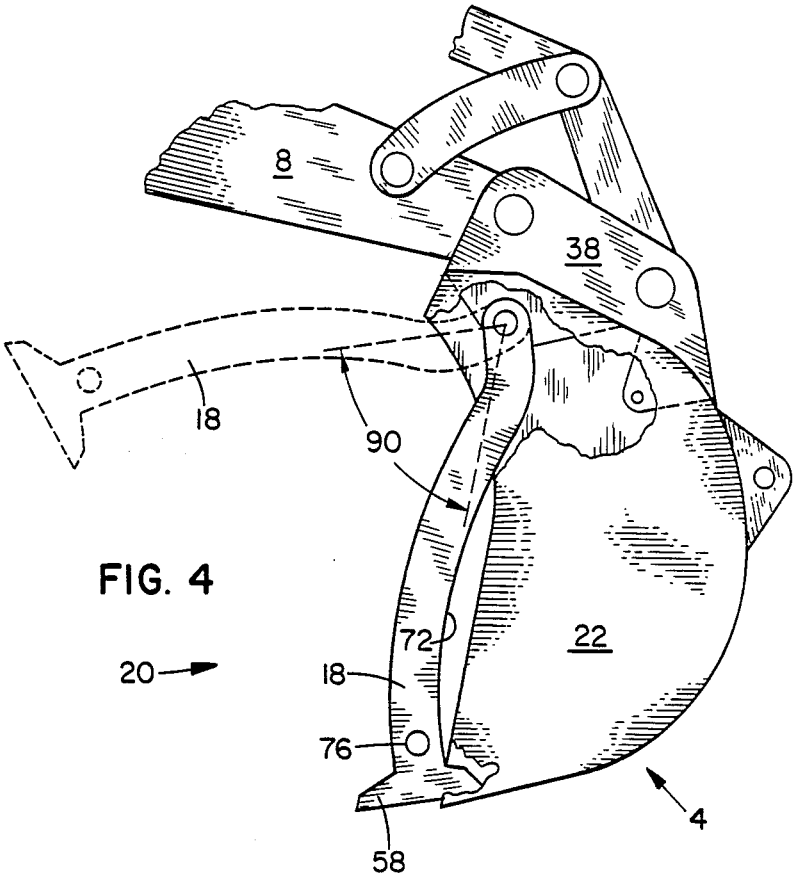
FIG. 4 is a side elevation of a further embodiment of the triple-purpose attachment of the invention.

In FIG. 4, the invention has an arm 18 which is double-curved or S-shaped to permit a wide pivot angle 90 without the use of recess 48 of FIG. 2. The arm nevertheless retains a concave clamping side 72 for holding objects between itself and bucket 4. For the sake of clarity, the hydraulic motive means comprising hydraulic cylinder 64 and piston rod 66 are not shown in FIG. 4.

Figure 5:
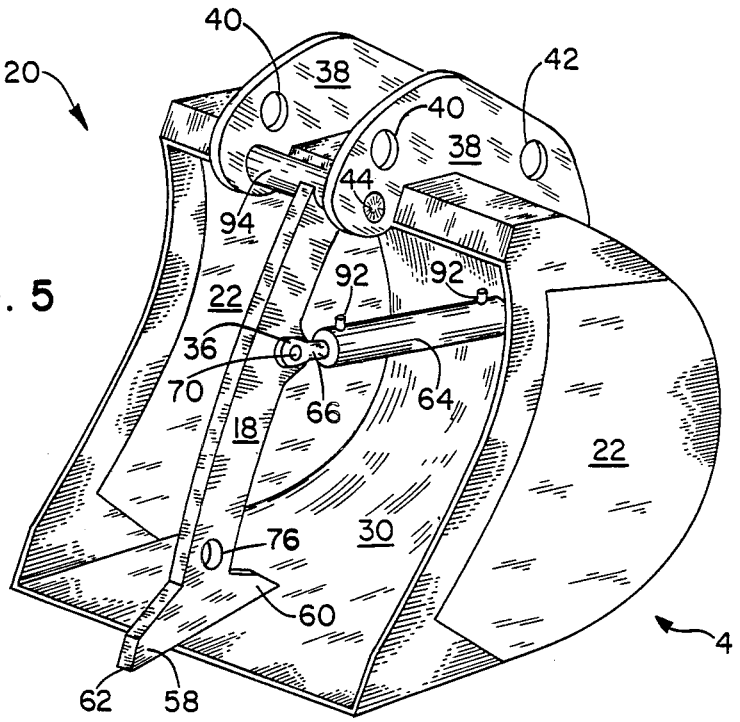
FIG. 5 is a perspective view of another embodiment of the invention.

In the embodiment shown in FIG. 5, clamping/scarifying arm 18 includes boss 94 at its proximal or upper end. Boss 94 is pivotably mounted on pin 44 between bucket mounting members 38, and pivots about pin 44. Thus, boss 94 comprises the upper terminus of arm 18. For the sake of clarity, the dipper stick 8 and hinge pins 78 and 80 are not shown. As previously described, arm 18 is motivated by piston rod 66 and hydraulic cylinder 64, the latter pivotably attached to the inner, concave bucket pan 28. In this embodiment, pin 44 and boss 94 are located below front apertures 40 to prevent interference with the desired rotation of the attachment 20. In a limited case, both boss 94 and dipper stick 8 rotate or pivot about the same pin 78 which passes through front apertures 40.

Figure 5A:
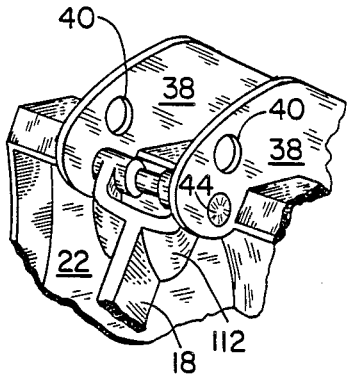
FIG. 5A is an orthographic view of the upper portion of the clamping/scarifying arm of a variation of the invention.

FIG. 5A, a further embodiment of the pivotable arm attachment of FIG. 5 is illustrated. A tang 112 at the upper end of arm 18 is pivoted on pin 44 which spans the distance between the two bucket mounting members 38.

Figure 6:
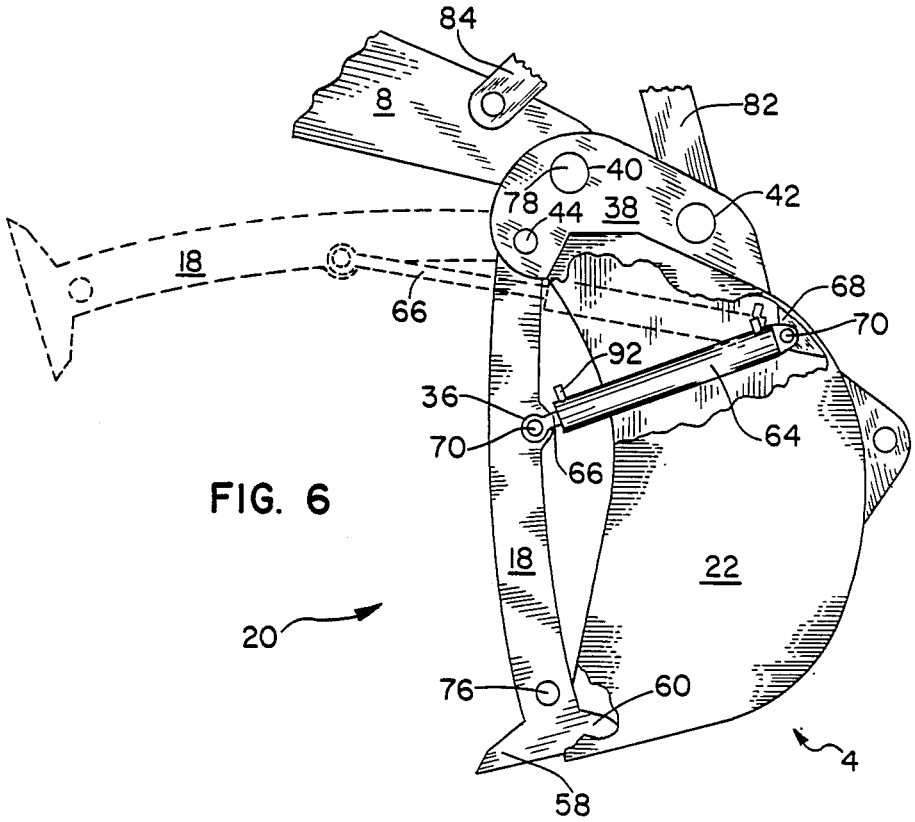
FIG. 6 is a side elevation view of the embodiment of FIG. 5.

FIG. 6 is an elevation side view of the embodiment of FIG. 5, attached to dipper stick 8 and arm link 82 by hinge pins 78 and 80 mounted in apertures 40 and 42, respectively. Clamping/scarifying arm 18 is pivotably mounted on hinge pin 44.

Figure 7:
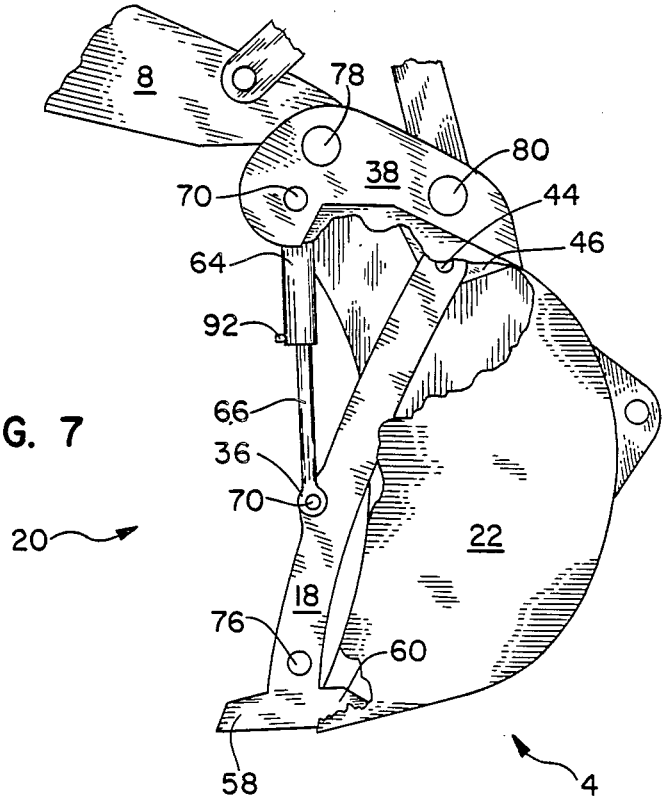
FIG. 7 is side elevation view of further a embodiment of the invention.

A further embodiment of the invention is illustrated in FIG. 7. In this arrangement, the pivot points of the clamping/scarifying arm 18 and hydraulic cylinder 64 are opposite that of FIGS. 4 and 5. Arm 18 pivots about pin 44 through arm mount 46 fixedly attached to the inner side of pan 28. Hydraulic cylinger 64 is pivotably attached to bucket 4 between bucket mounting members, e.g. by pin 70. Not visible in this view, upper pan portion 34 may include a recess 48, similar to the embodiment of FIG. 2, for passage of cylinder 64 therethrough when piston 66 is extended to pivot arm 18 downward toward the bucket. Also, cylinder 64 may include a boss at its upper end to pivot about pin 70.

Figure 8:
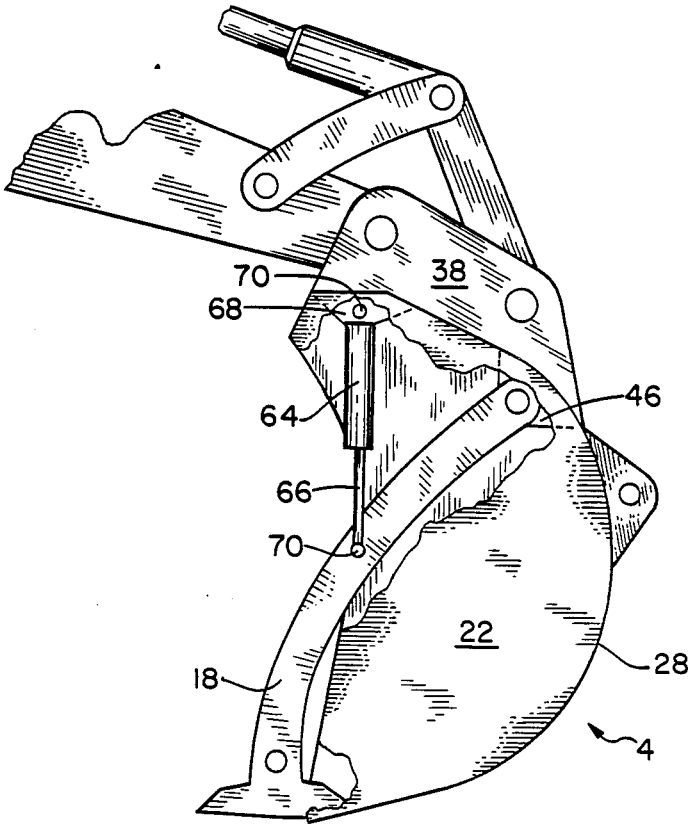
FIG. 8 is a side elevation view of another embodiment of the invention.

FIG. 8 shows a further arrangement of pivot locations of clamping/scarifying arm 18 and hydraulic cylinder 64. In this particular embodiment, cylinder 64 is pivotably mounted on cylinder mount 68 inside bucket 4, and arm 18 is likewise pivotably attached to its mount 46 which is fixedly attached to the inside back portion of the pan 28. As in the embodiment of FIG. 7, upper pan portion 28 may be recessed for passage of cylinder 64 therethrough, in particular when the piston 66 is retracted to fully extend arm 18.

Figure 9:
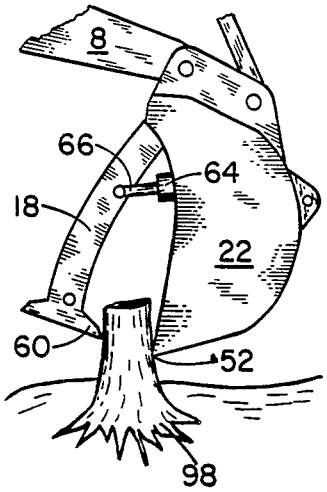
FIG. 9 is a side elevation of an embodiment of the triple-purpose attachment of this invention, illustrating its use in grasping and lifting objects with the toothed end of the arm.

In FIG. 9, the invention is shown pulling a stump from the ground. Actuation of the hydraulic motive means, that is, retraction of piston rod 66 by cylinder 64 clamps the stump 98 between rear tooth 60 and leading edge 52.

Figure 10:
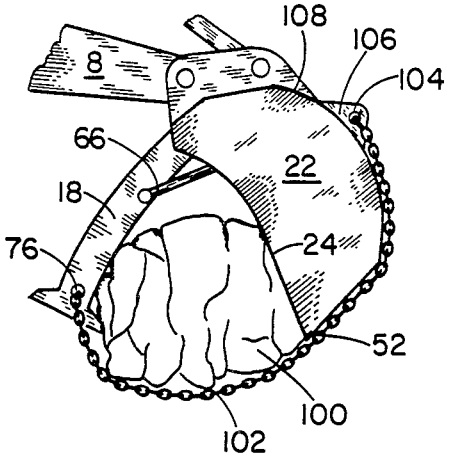

The invention is shown in FIG. 10, used for lifting a large rock 100. The rock is clamped between clamping/scarifying arm 18 and the leading edge 52 and forward edges 24 of the side walls 22. To assist in lifting such heavy objects, chain 102 is suspended between arm aperture 76 and aperture 104 in chain/cable attachment 106. The latter is mounted on the exterior surface 108 of pan 28. Heavy and bulky loads may be readily lifted and moved whereas the same loads cannot be easily and safely lifted and moved without arm 18.

Figure 11:
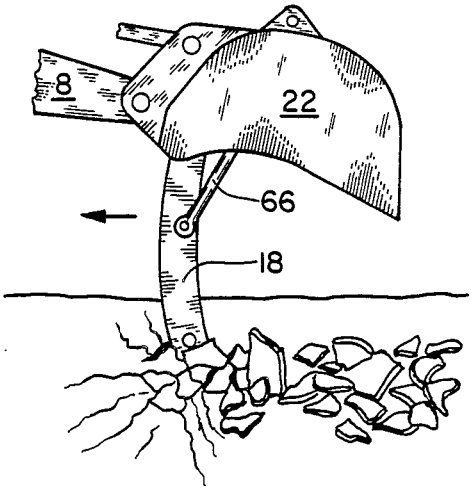
FIG. 11 is a side elevation of this invention, illustrating its use in ripping crustaceous material.

In FIG. 11, the invention is shown with the bucket in the inverted position and arm 18 extended away from the bucket, in a vertical position. The forward tooth, not shown, is pulled beneath a layer of hard material such as pavement or concrete to scarify or break it up for excavation. In this position, objects such as roots and stumps may be dislodged and ripped from the ground to enable ready excavation of the earth and objects therein and thereon.

Figure 12:
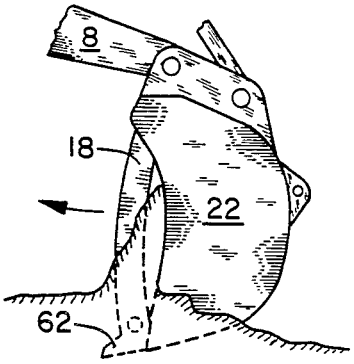
FIG. 12 is a side elevation of the present invention, showing its utility in simultaneously ripping and excavating.

In FIG. 12, the invention is shown with the bucket 4 in the excavating position and arm 18 in the lowered position just forward of the bucket. In this position, the ground may be ripped and scooped up by the bucket in one operation.

Minor changes may be made to the form and construction of the present invention without departing from the material spirit and scope thereof as claimed.

What is claimed is:

1. A unitary triple-purpose attachment for an articulated excavation machine, comprising:

an earthworking bucket having two sides joined by a generally concave pan with a leading excavating edge;

bucket mounting members fixedly attached to said bucket for pivotably mounting said bucket to said articulated excavation machine for moving and pivoting said bucket;

a clamping/scarifying arm having a toothed lower end and mounted at its upper end to said bucket or bucket mounting members to pivot in a fixed arc in a vertical plane bisecting said concave bucket pan from top to bottom, said arm pivotable between an upper position away from said bucket and a lower position wherein said toothed lower end is adjacent said leading excavating edge, wherein said toothed lower end comprises a forward facing sharp tooth and a rearward facing sharp tooth; and hydraulic motive means having one end pivotally attached to said clamping/scarifying arm and having the opposite end thereof pivotably mounted to move said clamping/scarifying arm in said fixed arc.

2. The triple-purpose attachment according to claim 1, wherein:

said hydraulic motive means has said opposite end pivotably mounted on said bucket for controlling position of said clamping/scarfying arm relative to said bucket.

3. The triple-purpose attachment according to claim 1, wherein:

said clamping/scarifying arm is pivotable through an angle of at least 45 degrees.

4. The triple-purpose attachment according to claim 1, wherein:

said clamping/scarifying arm is pivotable through an angle of at least 60 degrees.

5. The triple-purpose attachment according to claim 1, wherein:

said rearward facing sharpened tooth has a sole which rests on said bucket pan when said clamping/scarifying arm is in said lower position.

6. The triple-purpose attachment according to claim 1, wherein:

said clamping-scarifying arm is pivotably attached at its upper end to an upper portion of said pan.

7. The triple-purpose attachment according to claim 6, wherein:

said hydraulic motive means comprises a hydraulic cylinder ram pivotably attached at one end to said pan at a position lower than said upper end of said arm, and having an opposite end pivotably attached to said clamping-scarifying arm for movement thereof relative to said bucket.

8. The triple-purpose attachment according to claim 6, wherein:

said hydraulic motive means comprises a hydraulic cylinder ram pivotably attached at one end to said pan at a position higher than said upper end of said arm, and having an opposite end pivotably attached to said clamping/scarifying arm for movement thereof relative to said bucket.

9. The triple-purpose attachment according to claim 6, wherein:

said hydraulic motive comprises a hydraulic cylinder ram pivotally attached at one end to said bucket mounting members, and having an opposite end pivotably attached to said clamping/scarifying arm for movement thereof relative to said bucket.

10. The triple-purpose attachment according to claim 1, wherein:

said clamping/scarifying arm is pivotably attached at its upper end to said bucket mounting members.

11. The triple-purpose attachment according to claim 10, wherein:

said hydraulic motive means comprises a hydraulic cylinder ram pivotably attached to said pan at a position lower than said upper end of said arm, and having an opposite end pivotably attached to said clamping/scarifying arm for movement thereof relative to said bucket.

12. The triple-purpose attachment according to claim 1, wherein:

said upper part of pan is recessed for passage of said clamping/scarifying arm therethrough.

13. The triple-purpose attachment according to claim 1, wherein:

said upper part of pan is recessed for passage of said hydraulic motive means therethrough.

14. The triple-purpose attachment according to claim 1, wherein:

said clamping/scarifying arm is curved outward away from said bucket in its central portion for clamping objects between said arm and said bucket.

* * * * *